United States Patent [19]

Nakashima et al.

[11] Patent Number: 4,771,610

[45] Date of Patent: Sep. 20, 1988

[54] MULTIROOM AIR CONDITIONER

[75] Inventors: Yasuo Nakashima; Akio Fukushima; Junji Tamari; Kiyoshi Sakuma; Yoshiaki Tanimura; Yasuo Sato, all of Shizuoka; Hitoshi Iijima, Amagasaki; Fumio Matsuoka, Kamakura; Mitsuo Umehara, Tokyo, all of Japan

[73] Assignee: Mitsubishi Denki Kabushiki Kaisha, Japan

[21] Appl. No.: 57,033

[22] Filed: Jun. 3, 1987

[30] Foreign Application Priority Data

| | | | |
|---|---|---|---|
| Jun. 6, 1986 | [JP] | Japan | 61-131243 |
| Nov. 4, 1986 | [JP] | Japan | 61-262377 |
| Dec. 3, 1986 | [JP] | Japan | 61-287983 |
| Dec. 3, 1986 | [JP] | Japan | 61-287984 |

[51] Int. Cl.[4] ..... F25B 13/00

[52] U.S. Cl. ..... 62/160; 62/204; 62/324.1; 62/324.6

[58] Field of Search ..... 62/160, 324.1, 324.6, 62/204

[56] References Cited

U.S. PATENT DOCUMENTS

| | | | |
|---|---|---|---|
| 3,307,368 | 3/1967 | Harnish | 62/204 X |
| 4,487,031 | 12/1984 | Rogers et al. | 62/160 |
| 4,620,423 | 11/1986 | Hopkinson et al. | 62/160 X |
| 4,644,756 | 2/1987 | Sugimoto et al. | 62/160 |

FOREIGN PATENT DOCUMENTS 55-28993 7/1980 Japan .

*Primary Examiner*—Lloyd L. King

*Attorney, Agent, or Firm*—Leydig, Voit & Mayer

[57] ABSTRACT

A multiroom air conditioner has a plurality of indoor heat exchangers connected to a single outdoor heat exchanger. A reversible expansion valve is installed on a liquid-side branch pipe for each of the indoor heat exchangers, and a solenoid valve is installed on a gas-side branch pipe for each indoor heat exchanger. Temperature sensors are provided on the liquid-side branch pipes, on the gas-side branch pipes, and on the outlet side during cooling of the outdoor heat exchanger. A pressure sensor or a temperature sensor detects the saturation temperature on the high-pressure side of the compressor. Based on the saturation temperature on the high-pressure side of the compressor, the temperature on the outlet side during cooling of the outdoor heat exchanger, and the temperatures in the liquidside branch pipes, a controller controls the expansion valves so as to obtain a target degree of subcooling during cooling and heating. The controller can also control the expansion valves so that the temperatures in each of the branch pipes are approximately equal to one another.

10 Claims, 13 Drawing Sheets

MULTIROOM AIR CONDITIONER

BACKGROUND OF THE INVENTION

This invention relates to a multiroom air conditioner of the type having a plurality of indoor air conditioning units connected to a single outdoor air conditioning unit.

FIG. 1 is a schematic diagram of a conventional single-room, separate-type air conditioner having a single indoor air conditioning unit (hereinunder referred to as an indoor unit) which is connected to a single outdoor air conditioning unit (hereinunder referred to as an outdoor unit). The indoor unit consists primarily of an indoor heat exchanger 5. The outdoor unit comprises a compressor 1, a four-way valve 2 which is connected to the discharge side of the compressor 1, an outdoor heat exchanger 3 which is connected to the four-way valve 2 and the indoor heat exchanger 5, an accumulator 4 which is connected between the four-way valve 2 and the suction port of the compressor 1, and a throttling mechanism in the form of two capillary tubes 7 which are connected in series between the outdoor heat exchanger 3 and the indoor heat exchanger 5. A check valve 8 is connected in across one of the capillary tubes 7. Switching between cooling operation and heating operation is performed by switching the four-way valve 2 from the position shown by the solid lines (cooling mode) to that shown by the dashed lines (heating mode). The solid arrows show the flow of refrigerant during cooling mode, and the dashed arrows illustrate the flow during heating mode. As throttling is performed by capillary tubes 7, the refrigerant circuit of a single-room separate-type air conditioner is extremely simple and inexpensive.

In contrast, a multiroom air conditioner having a single outdoor unit and a plurality of indoor units has a much more complicated structure. FIG. 2 is a schematic diagram of a conventional multiroom air conditioner which was disclosed in Japanese Utility Model Laid-Open No. 55-28993. Elements numbers 1 through 4 are the same as in FIG. 1, while elements 5*a* and 5*b* are a pair of indoor heat exchangers of two indoor units which are connected in parallel to the outdoor heat exchanger 3 of an outdoor unit. Two gas-side solenoid valves 6*a* and 6*b* are installed on the gas-side branch pipes for the two indoor heat exchangers 5*a* and 5*b*, and two liquid-side solenoid valves 10*a* and 10*b* are installed on the liquid-side branch pipes. In addition to a throttling mechanism for the outdoor unit in the form of an expansion valve 9 which is connected in parallel with a check valve 8 between the outdoor heat exchanger 3 and the liquid-side solenoid valves 10*a* and 10*b*, two expansion valves 11*a* and 11*b* are installed on the liquid sides of the two heat indoor exchangers 5*a* and 5*b*. Two check valves 12*a* and 12*b* are connected in parallel with the expansion valves 11*a* and 11*b*, respectively. A receiver 13 for liquid refrigerant is connected in series between the outdoor expansion valve 9 and the liquid-side solenoid valves 10*a* and 10*b*. As in FIG. 1, the solid arrows indicate refrigerant flow during cooling mode and the dashed arrows indicate flow during heating mode.

The indoor units of conventional single-room, separate-type air conditioners are manufactured in large quantities and are relatively inexpensive, so it is desirable to be able to employ them as the indoor units of multiroom air conditioners. However, it can be seen from comparison of FIG. 1 and FIG. 2 that as the indoor unit of a multiroom air conditioner must be equipped with expansion valves and check valves, it is difficult to adapt an indoor unit of a single-room air conditioner for use in a multiroom air conditioner.

In addition, in the conventional multiroom air conditioner of FIG. 2, since control of the degree of superheat is performed by expansion valves during cooling and heating mode, it is necessary to provide a receiver 13, and therefore two vessels for receiving refrigerant (the accumulator 4 and the receiver 13) are required to prevent refrigerant from flowing back into the compressor 1 during a transitory state.

Furthermore, in a conventional multiroom air conditioner, the liquid refrigerant at the confluence point of the liquid-side branch pipes is under high pressure during heating operation. If even one of the indoor units is stopped, it is necessary to provide an unillustrated refrigerant recovery circuit comprising a check valve and a capillary tube for recovering the refrigerant within the halted unit and bringing it to the low-pressure side of the compressor. As a result, the overall refrigerant circuit ends up being complicated.

SUMMARY OF THE INVENTION

It is therefore an object of the present invention to provide a multiroom air conditioner which can employ the indoor units of conventional single-room, separate-type air conditioners without alterations of the indoor units.

It is another object of the present invention to provide a multiroom air conditioner which does not employ a receiver for liquid refrigerant.

It is yet another object of the present invention to provide a multiroom air conditioner which does not require a refrigerant recovery circuit for recovering liquid refrigerant from a halted indoor unit.

It is still another object of the present invention to provide a multiroom air conditioner which is capable of maintaining the degree of subcooling of the liquid refrigerant on the outlet side of the indoor or outdoor heat exchangers at a target value.

It is a further object of the present invention to provide a multiroom air conditioner which can maintain the temperatures on the outlet sides of indoor heat exchangers approximately equal to one another.

It is still another object of the present invention to provide a multiroom air conditioner which can distribute refrigerant among the indoor units in accordance with the capacity of each indoor unit.

It is another object of the present invention to provide a multiroom air conditioner which can automatically determine whether the amount of refrigerant in the system is adequate.

It is yet another object of the present invention to provide a multiroom air conditioner which can automatically adjust the level of refrigerant in an accumulator so as to maintain a suitable level.

A multiroom air conditioner in accordance with the present invention has a plurality of indoor units which are connected to a single outdoor unit. Each indoor unit has an indoor heat exchanger which is connected in parallel with the other indoor heat exchangers to the outdoor heat exchanger of the outdoor unit by a plurality of gas-side branch pipes and a plurality of liquid-side branch pipes. The indoor heat exchangers of conventional single-room air conditioners can be used without alteration as the indoor heat exchangers of the present invention. The outdoor unit has a compressor, an accumulator which is connected to the suction side of the compressor, and a four-way valve by which the discharge side of the compressor can be connected to the outdoor heat exchanger or the indoor heat exchangers during cooling or heating operation, respectively. A reversible expansion valve and a liquid-side temperature sensor are disposed on each of the liquid-side branch pipes, and a solenoid valve is disposed on each of the gas-side branch pipes. A temperature sensor is disposed on the outlet side during cooling of the outdoor heat exchanger, and a means for detecting the saturation temperature on the high-pressure side of the compressor is disposed on the discharge side of the compressor. A controller controls the degree of opening of the expansion valves based on the outputs of the temperature sensors and the means for detecting the saturation temperature so that the degree of subcooling at the outlet of the outdoor heat exchanger is maintained at a target value during cooling and such that the degree of subcooling at the outlets of the indoor heat exchangers is maintained at a target value during heating.

In a preferred embodiment, a gas-side temperature sensor is disposed on each of the gas-side branch pipes, and based on the outputs of the gas-side temperature sensors and the liquid-side temperature sensors, the controller controls the degree of opening of the expansion valves so that the temperatures within the gas-side branch pipes are approximately equal to one another during cooling operation, and such that the temperatures within the liquid-side branch pipes are approximately equal to one another during heating operation.

In another embodiment, capacity-setting switches are provided for inputting the capacity of each of the indoor heat exchangers to the controller. The controller controls the degree of opening of the expansion valves based on the input from the capacity-setting switches such that the supply of refrigerant to the indoor heat exchangers is distributed among them in accordance with the capacity of each one.

The present invention may further comprise a level detector which detects the level of refrigerant in the accumulator and produces a corresponding output signal. In one embodiment, the controller automatically determines whether the amount of refrigerant in the air conditioner system is adequate based on the output of the level detector. In another embodiment, the controller automatically changes the target degree of subcooling at the outlet of the outdoor or indoor heat exchangers based on the output of the level detector so that the refrigerant level in the accumulator is increased when it is below a minimum desirable level and so that the refrigerant level in the accumulator is decreased when it is above a maximum desirable level.

In one embodiment, the means for determining the saturation temperature on the high-pressure side of the air conditioner is a pressure sensor which measures the pressure near the discharge port of the compressor. The controller then calculates the saturation temperature corresponding to this pressure.

In another embodiment, the means for determining the saturation temperature comprises a temperature-sensor which directly measures the saturation temperature.

BRIEF DESCRIPTION OF THE DRAWINGS

In the drawings, the same reference numerals indicate the same or corresponding parts.

DESCRIPTION OF THE PREFERRED EMBODIMENTS

Figure 1:
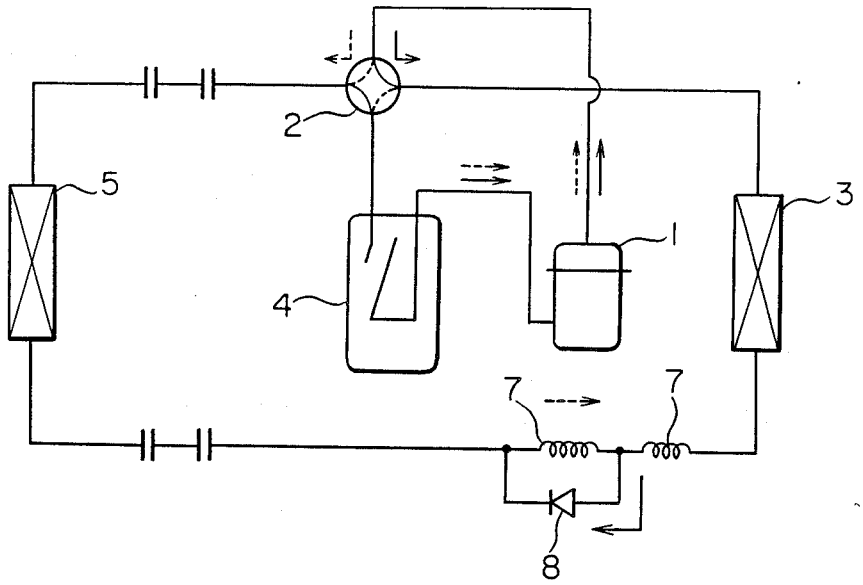
FIG. 1 PRIOR ART
FIG. 1 is a schematic diagram of a conventional single-room air conditioner having a single indoor unit and a single outdoor unit.
Figure 2:
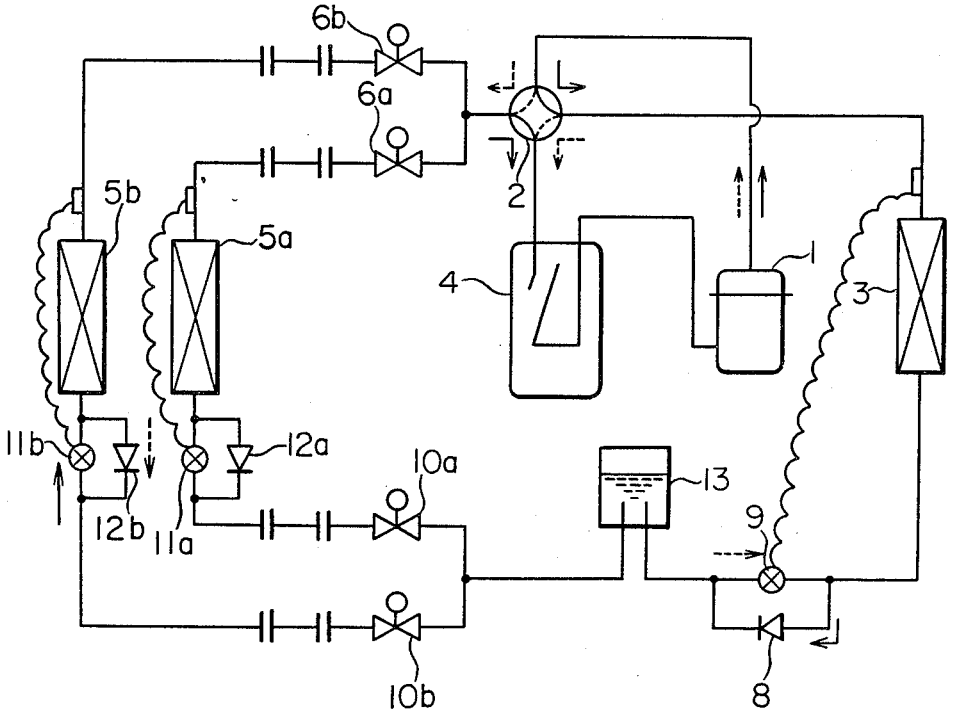
FIG. 2 PRIOR ART
FIG. 2 is a schematic diagram of a conventional multiroom air conditioner having a plurality of indoor units and a single outdoor unit.
Figure 3:
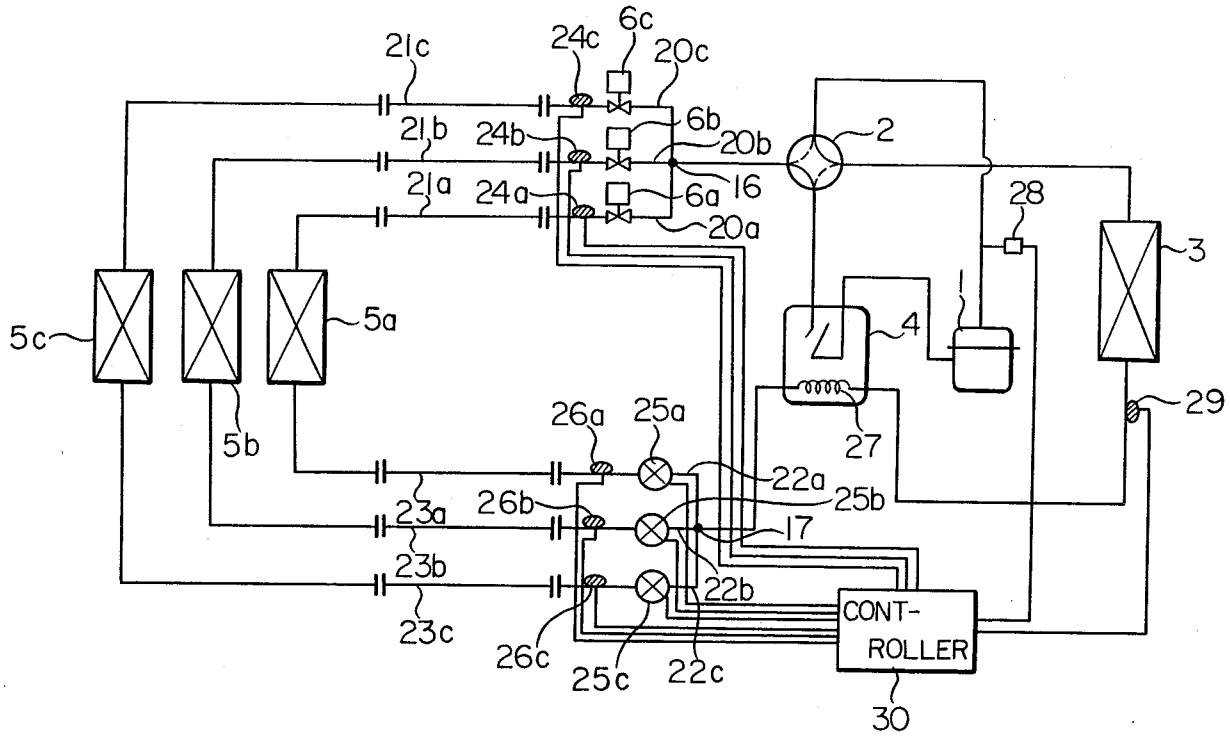
FIG. 3 is a schematic diagram of a first embodiment of the present invention.

A number of preferred embodiments of a multiroom air conditioner in accordance with the present invention will now be described while referring to the accompanying drawings. As shown in FIG. 3, which is a circuit diagram of a first embodiment, the discharge side of a compressor 1 is connected to a selector valve in the form of a four-way valve 2. The suction side of the compressor 1 is connected to the gas discharge pipe of an accumulator 4. During coòling operation, the four-way valve 2 is turned as shown by the solid lines so that the discharge side of the compressor 1 is connected to the intake side of an outdoor heat exchanger 3 and the intake pipe of the accumulator 4 is connected the gas-side confluence point 16 of three gas-side branch pipes 20*a*–20*c*. During heating operation, the four-way valve 2 is turned as shown by the dashed lines so that the discharge side of the compressor 1 is connected to the gas-side confluence point 16, and the outlet side of the outdoor heat exchanger 3 is connected to the intake pipe of the accumulator 4. The outlet slde during cooling of the outdoor heat exchanger 3 is connected to the liquid-side confluence point 17 of three liquidside branch pipes 22*a*–22*b* through a heat exchanger 27 which is immersed in the liquid refrigerant contained within the accumulator 4. The gas-side branch pipes 20*a*–20*c* are connected by three gas-side connecting pipes 21*a*–21*c* to the gas sides of three indoor heat exchangers 5*a*–5*c* of three indoor air conditioning units, respectively. As the indoor heat exchangers 5*a*–5*c*, the indoor units of conventional single-room air conditioners like that illustrated in FIG. 1 can be used without alterations. The liquid sides of the indoor heat exchangers 5*a*–5*c* are connected to the three liquid-side branch pipes 22*a*–22*c* through three liquid-side connecting pipes 23*a*–23*c*, respectively. Three solenoid valves 6*a*–6*c* are installed on the three gas-side branch pipes 20*a*–20*c*, respectively. Three gas-side temperature sensors 24*a*–24*c* for measuring the temperature in the gas-side branch pipes 20*a*–20*c* are installed thereon between the solenoid valves 6*a*–6*c* and the indoor heat exchangers 5*a*–5*c*, respectively. Similarly, three electrically-controlled, reversible expansion valves 25*a*–25*c* and three temperature sensors 26*a*–26*c* are disposed on the three liquid-side branch pipes 22*a*–22*c*, respectively. A pressure sensor 28 which produces an electrical output signal is installed on the discharge side of the compressor 1. A temperature sensor 29 is disposed on the outlet pipe during cooling of the outdoor heat exchanger 3. The output signals which are produced by the gasside temperature sensors 24*a*–24*c*, the liquid side temperature sensors 26*a*–26*c*, the pressure sensor 28, and temperature sensor 29 are input to a controller 30, which controls the degree of opening of the expansion valves 25*a*–25*c* and the opening and closing of the solenoid valves 6*a*–6*c*.

Figure 4:
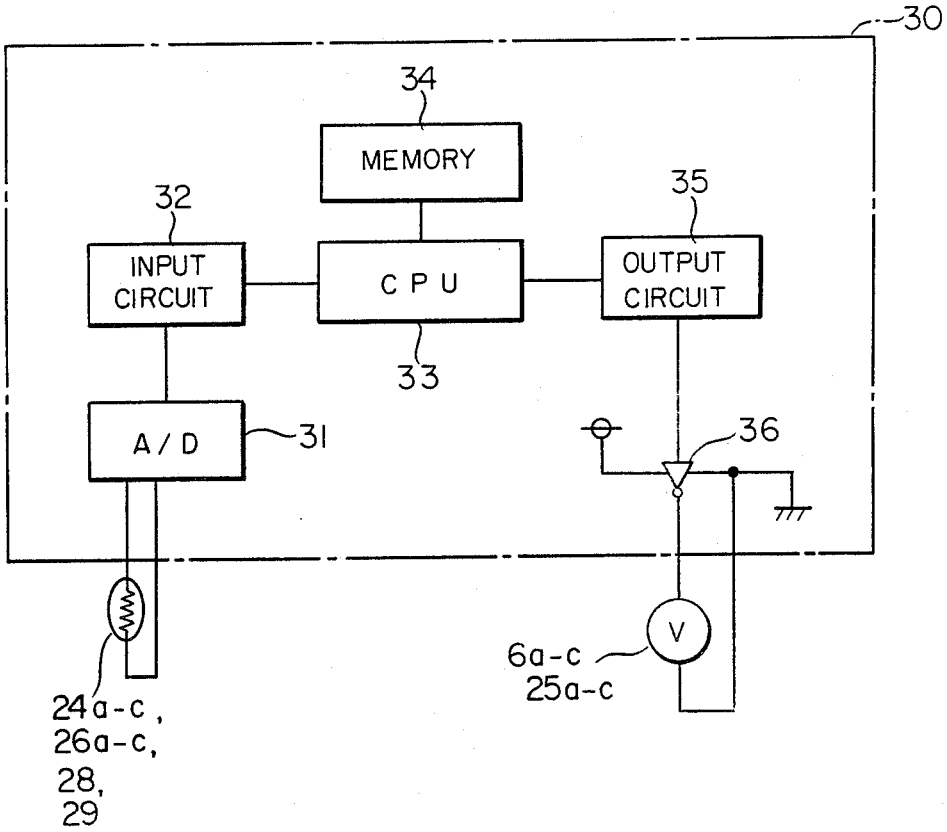
FIG. 4 is a block diagram of the controller 30 of the embodiment of FIG. 3.

FIG. 4 is a block diagram illustrating the structure of the controller 30. The electrical output signals from the temperature sensors 24*a*–24*c*, 26*a*–26*c*, and 29 and from the pressure sensor 28 are converted into digital signals by an A/D converter 31 and input to a CPU 33 via an input circuit 32. The CPU 34 is connected to a memory 34 and an output circuit 35, which is connected to the solenoid valves 6*a*–6*c* and the expansion valves 25*a*–25*c* via a buffer 36.

The flow of refrigerant through the circuit illustrated in FIG. 3 during cooling operation is as follows. High-pressure gaseous refrigerant is discharged from the compressor 1 and enters the outdoor heat exchanger 3, where it is condensed. After leaving the outdoor heat exchanger 3, the liquid refrigerant is subcooled to well below the saturation temperature in the heat exchanger 27 which is disposed within the accumulator 4. From the heat exchanger 27, the subcooled liquid refrigerant enters the three liquid-side branch pipes 22*a*–22*c* and is reduced in pressure by the expansion valves 25*a*–25*c*. It then enters the indoor heat exchangers 5*a*–5*c*, where it evaporates and cools the air in the rooms in which the indoor heat exchangers are installed. From the indoor heat exchangers 5*a*–5*c*, it passes through the solenoid valves 6*a*–6*c* on the gas-side branch pipes 20*a*–20*c*. After the gaseous refrigerant converges at the gas-side confluence point 16, it returns to the compressor 1 via the four-way valve 2 and the accumulator 4.

Figure 5:
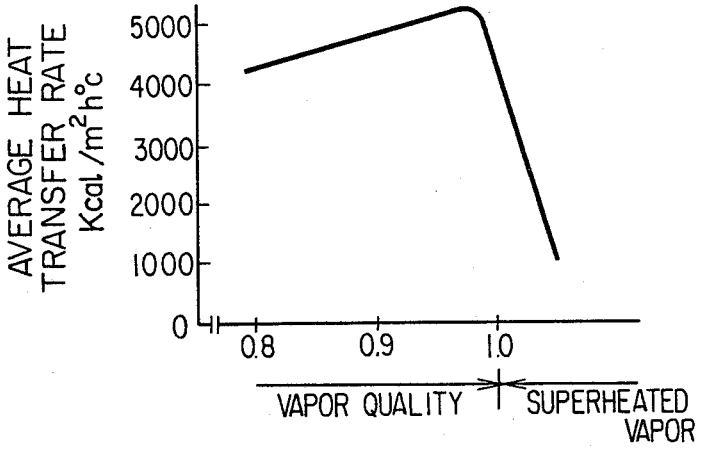
FIG. 5 is a graph of the relationship between the average heat transfer rate of the refrigerant and the vapor quality thereof.

As the refrigerant is circulating through the system in this manner, the controller 30 controls the degree of opening of the expansion valves 25*a*–25*c* so as to achieve a constant degree of subcooling at the outlet of the outdoor heat exchanger 3, so as to equalize the temperatures in the gas-side branch pipes 20*a*–20*c*, and so that the refrigerant at the outlets of the indoor heat exchangers 5*a*–5*c* during cooling is a moist vapor. The importance of the refrigerant being a moist vapor is illustrated in FIG. 5, which is a graph of the average heat transfer rate of the refrigerant as a function of its vapor quality. When the refrigerant at the outlets of the indoor heat exchangers 5*a*–5*c* is a superheated vapor, the average heat transfer rate abruptly falls, and the heat exchanging capacity of the indoor heat exchangers 5*a*–5*c* accordingly decreases. In order to maintain the performance of the indoor heat exchangers, the vapor quality of the refrigerant at the outlets of the indoor heat exchangers 5*a*–5*c* should be on the order of 0.9. Therefore, the expansion valves 25*a*–25*c* are controlled by the controller 30 so as to increase the degree of subcooling and create a moist state at the outlets of the indoor heat exchangers 5*a*–5*c*.

Figure 6:
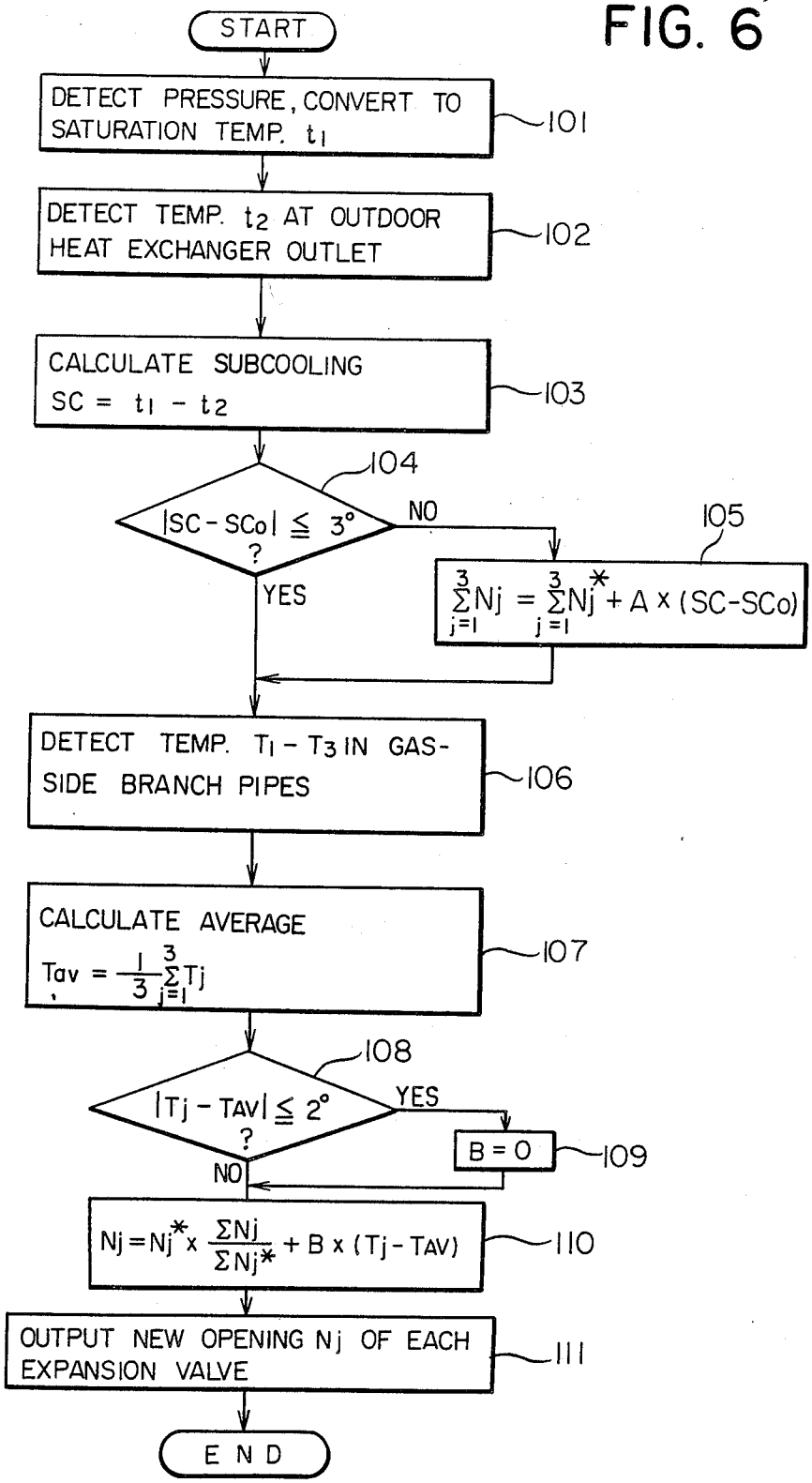
FIG. 6 is a flow chart of a program executed by the controller of the embodiment of FIG. 3.

The process by which the controller 30 controls the expansion valves 25*a*–25*c* is illustrated in FIG. 6, which is a flow chart of a program executed by the CPU 33. First, in Step 101, the pressure sensor 28 detects the pressure on the discharge side of the compressor 1 and produces a corresponding output signal which is input to the CPU 33. 8ased on the detected pressure, the CPU 33 calculates the saturation-temperature t1 on the high-pressure side of the refrigerant circuit. In Step 102, the temperature t2 at the outlet of the outdoor heat exchanger 3 is detected by temperature sensor 29 and is input to the CPU 33. In Step 103, the CPU 33 calculates t1–t2, which is the degree of subcooling SC of the liquid refrigerant leaving the outdoor heat exchanger 3. In Step 104, the CPU 33 determines whether the absolute value of the difference between the actual degree of subcooling SC and a target value SCo is greater than a prescribed amount, such as 3° C. If the difference does not exceed 3° C., the program goes directly to Step 106, but if the difference exceeds 3° C., then it is necessary to adjust the degree of opening of the expansion valves 25*a*–25*c* so as to bring the degree of subcooling SC towards the target value SCo, and in Step 105, a a new total degree of opening $\Sigma N_j$ of the three expansion valves 25*a*–25*c* is calculated using the formula $$\sum_{j=1}^{3} N_j = \sum_{j=1}^{3} N_j' + A \times (SC - SCo)$$

wherein $N_j$ is the new degree of opening of each expansion valve, $N_j'$ is the old degree of opening of each expansion valve, and A is an experimentally-determined constant.

From this formula, it can be seen that when the degree of subcooling is too large, the total degree of opening of the expansion valves is increased from its previous value, whereas if the degree of subcooling is too small, the total degree of opening is decreased. The program then proceeds to Step 106, in which the temperatures T1–T3 in the gas-side branch pipes 20*a*–20*c*, respectively, are detected by the temperature sensors 24*a*–24*c* and input to the CPU 30. In Step 107, the average Tav of the three temperatures is calculated, and in Step 108, it is determined whether the absolute value of the difference between Tav and each of T1–T3 exceeds a prescribed amount, such as 2° C. In Step 110, the new degree of opening Nj for each expansion valve 25*a*–25*c* is calculated using the formula shown in Step 110, in which B is an experimentally-determined constant. It can be seen that in accordance with this formula, the new degree of opening Nj contains a component $B\times(Tj-Tav)$ which corrects the degree of opening so as to equalize the temperatures in the three branch pipes. Namely, if the temperature Tj within a branch pipe is more than 2° C. greater than the average Tav, the component $B\times(Tj-Tav)$ is positive and tends to increase the degree of opening Nj of the corresponding expansion valve, leading to a decrease in the temperature Tj. On the other hand, if the temperature Tj is more than the 2° C. less than the average Tav, the component $B\times(Tj-Tav)$ is negative and tends to decrease the degree of opening Nj of the corresponding expansion valve, leading to an increase in the temperature Tj. In Step 111, the CPU 33 sends output signals to the expansion valves 25*a*–25*c* and changes the degree of opening of each one to the new value of Nj calculated in Step 110. As a result, the degree of subcooling SC at the outlet of the outdoor heat exchanger 3 is made to approach SCo, and the dispersion among the temperatures T1–T3 is decreased.

When one of the indoor units is stopped, the controller closes the expansion valve 25*a*, 25*b*, or 25*c* corresponding to that unit and refrigerant is prevented from entering it. At the same time, liquid refrigerant remaining in the halted unit is drawn into the accumulator 4 and accumulates there, so there is no need to provide a special refrigerant recovery circuit or a liquid refrigerant receiver.

During heating operation, the four-way valve 2 is turned as shown by the dashed lines in FIG. 3, and high-pressure gaseous refrigerant which is discharged from the compressor 1 passes through the gas-side branch pipes 20*a*–20*c*, the solenoid valves 6*a*–6*c*, and is led into the indoor heat exchangers 5*a*–5*c* by the gas-side connecting pipes 21*a*–21*c*, respectively. After condensing in the indoor heat exchangers 5*a*–5*c*, the liquid refrigerant passes through the liquid-side connecting pipes 23*a*–23*c* and is reduced in pressure by the expansion valves 25*a*–25*c*. After passing through the liquid-side branch pipes 22*a*–22*c* and heat exchanger 27, it enters the outdoor heat exchanger 3 where it evaporates and then returns to the compressor via the four-way valve 2 and the accumulator 4. At this time, the degree of opening of the expansion valves 25*a*–25*c* is controlled by the controller 30 based on the output signals from the liquid-side temperature sensors 26*a*–26*c* and the pressure sensor 28 in much the same manner as illustrated in FIG. 6 so that the degree of subcooling at the outlets of the indoor heat exchangers 5*a*–5*c* is maintained at approximately a target value and such that the temperatures in each of the liquid-side branch pipes are approximately the same.

When one of the indoor units is stopped during heating operation, the controller 30 closes the solenoid valve on the gas-side branch pipe and opens the expansion valve on the liquid-side branch pipe corresponding to that unit. As a result, the supply of refrigerant to the stopped indoor unit is cut off and the liquid refrigerant remaining in the unit accumulates in the accumulator 4 in the same manner as during cooling operation, so that it is not necessary to provide a special refrigerant recovery circuit or a receiver.

In the present embodiment, the fact that the expansion valves 25*a*–25*c* are controlled by a controller 30 in the form of a microcomputer is particularly advantageous if the rotational speed of the compressor 1 is controlled by an inverter or similar means.

Figure 7:
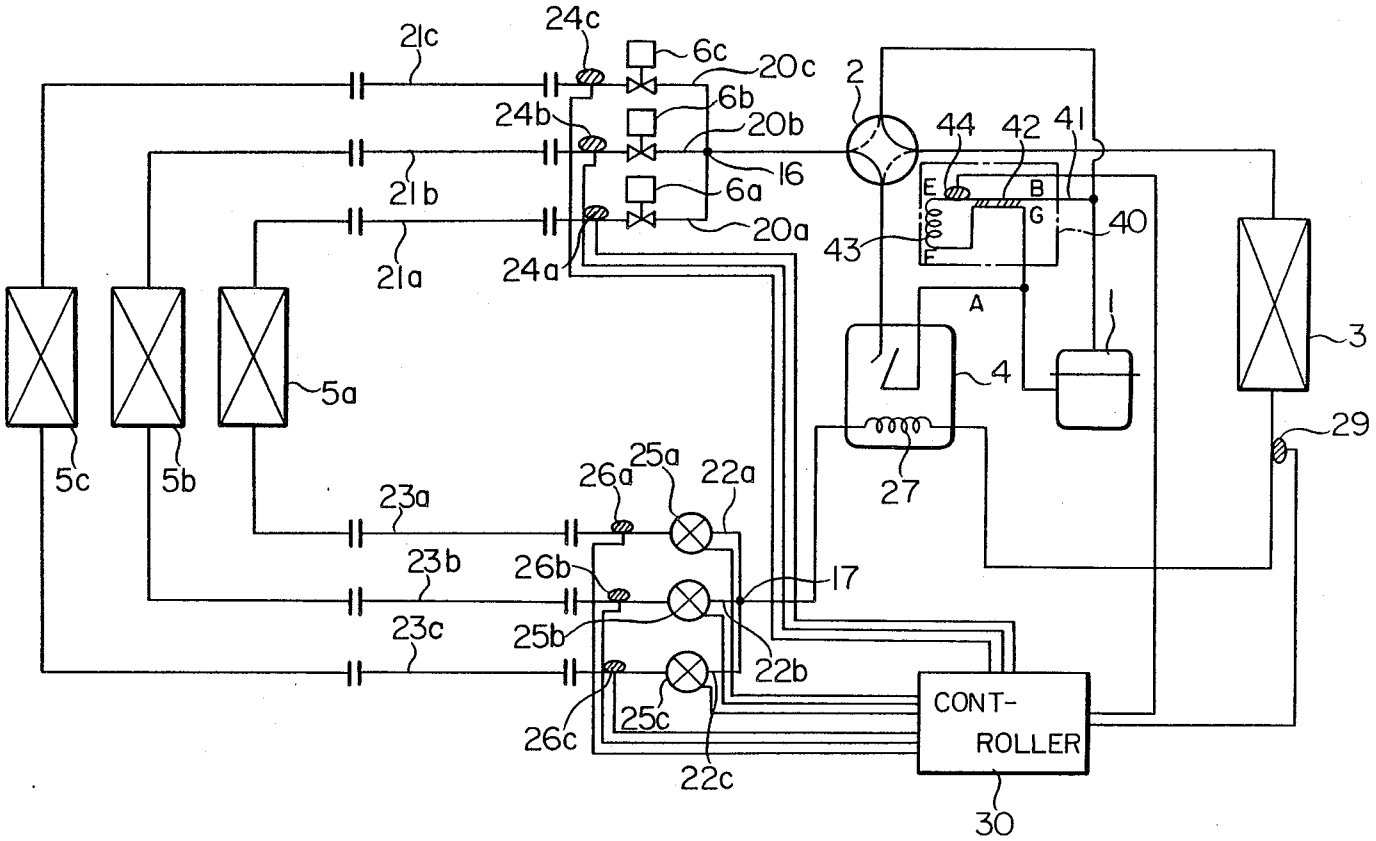
FIG. 7 is a schematic diagram of a second embodiment of the present invention which is equipped with a saturation temperature detecting circuit.

In the embodiment of FIG. 3, the saturation temperature on the discharge side of the compressor 1 is determined by measuring the discharge pressure with a pressure sensor 28 and then calculating the saturation temperature corresponding to this pressure. However, it is also possible to directly measure the saturation temperature on the discharge side. FIG. 7 illustrates a second embodiment of the present invention in which the pressure sensor 28 of FIG. 3 is replaced by a saturation temperature detecting circuit 40. The detecting circuit 40 has a branch pipe 41 which branches from the discharge pipe of the compressor 1 and is connected to one of the inlets of a heat exchanger 42. A capillary tube 43 is connected between one of the inlets and one of the outlets of the heat exchanger 42, and the remaining outlet of the heat exchanger 42 is connected to the suction side of the compressor 1. A temperature sensor 44 is installed on the upstream side of the capillary tube 43 so as to measure the temperature of the refrigerant which enters it. The temperature sensor 44 produces an electrical output signal which is input to the controller 30. The structure of this embodiment is otherwise identical to that of the previous embodiment.

A portion of the high-pressure gaseous refrigerant which is discharged by the compressor 1 enters the branch pipe 41 and is cooled in the heat exchanger 42 to become a two-phase refrigerant. It is then reduced in pressure in the capillary tube 43 to the suction pressure of the compressor 1 and becomes a low-temperature two-phase refrigerant. It again passes through the heat exchanger 42, becomes a low-pressure refrigerant having approximately the same enthalpy as the refrigerant at the compressor outlet, and is returned to the compressor 1.

Figure 8:
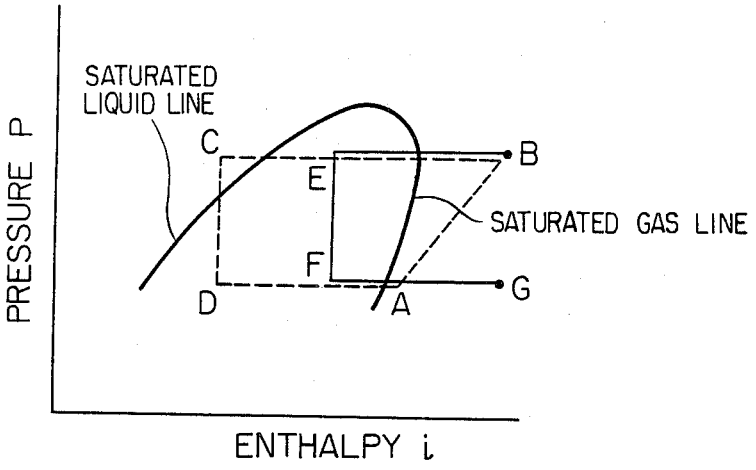
FIG. 8 is a Mollier diagram illustrating the state of the refrigerant within the saturation temperature detecting circuit of FIG. 7.

The state of the refrigerant within the detecting circuit 40 is illustrated by the solid lines BEFG in the Mollier diagram of FIG. 8. The dashed lines ABCD illustrate the state of the refrigerant in the main refrigerant circuit during a normal cooling cycle. Points E and F in the diagram represent the states of the refrigerant at the entrance and exit, respectively, of the capillary tube 43, and Points B and G represent the states of the refrigerant on the inlet side and the outlet side, respectively, of the heat exchanger 42. The temperature at Point E is the saturation temperature on the high-pressure side of the compressor 1. As the temperature sensor 44 measures this saturation temperature, the saturation temperature can be directly input to the CPU 33 without it being necessary to perform any calculations.

The operation of this embodiment during cooling and heating operation is the same as that of the previous embodiment, and the control program executed by the CPU 33 differs from that shown in FIG. 6 only in that in Step 101, instead of a pressure being input to the CPU 33, the saturation temperature tl on the high-pressure side is directly input by the temperature sensor 44.

Figure 9:
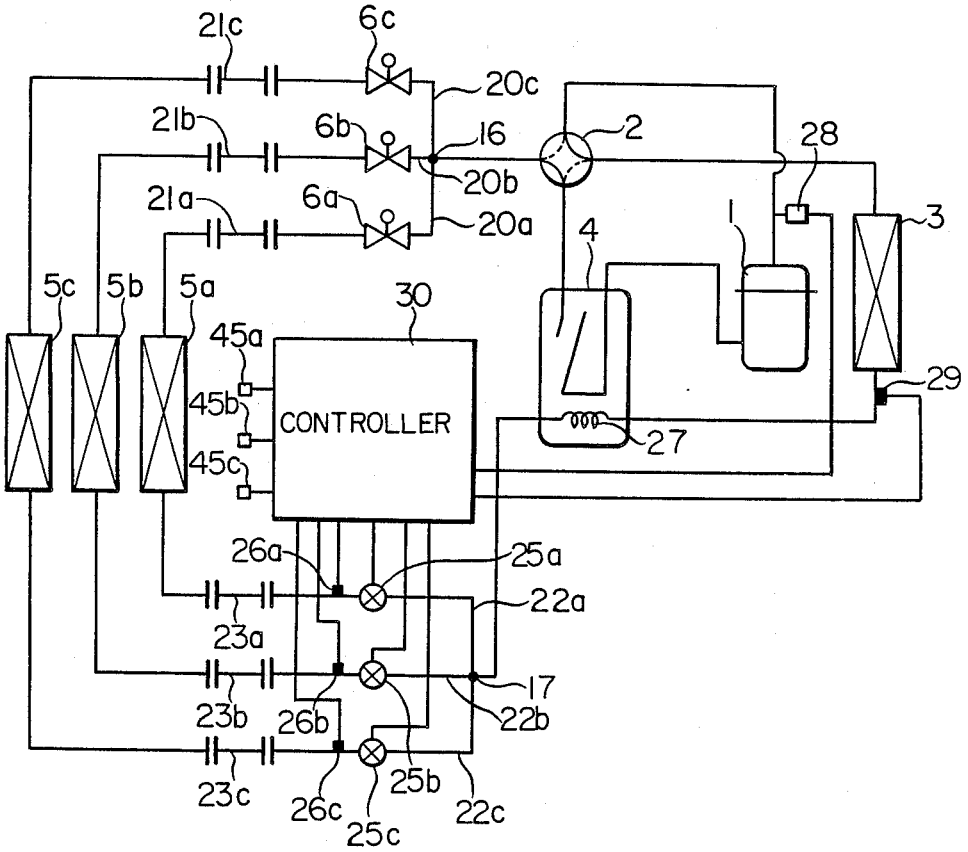
FIG. 9 is a schematic diagram of a third embodiment of the present invention which is equipped with capacity-setting switches for setting the capacity of each indoor unit.
Figure 10:
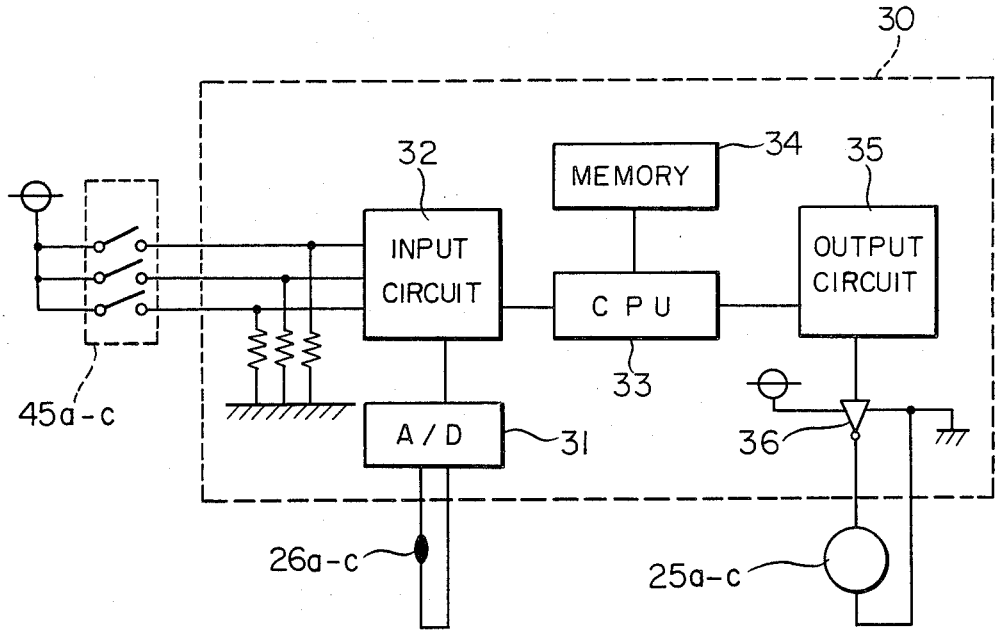
FIG. 10 is a block diagram of the controller of the embodiment of FIG. 9.

FIGS. 9 and 10 illustrate a third embodiment of the present invention which is equipped with three capacity-setting switches 45*a*–45*c* by means of which the capacities of the indoor heat exchangers 5*a*–5*c*, respectively, are input to the controller 30. Each of the switches is a three-bit switch which can be set to eight different values and which is connected to the input circuit 32 of the controller 30, as shown in FIG. 10. The switches 45*a*–45*c* are each set to a value referred to as the capacity code Q indicative of the size and thus the capacity of a corresponding indoor heat exchanger. This embodiment is not equipped with gas-side temperature sensor 24*a*–24*c*, but is otherwise identical to the embodiment of FIG. 3.

Figure 11:
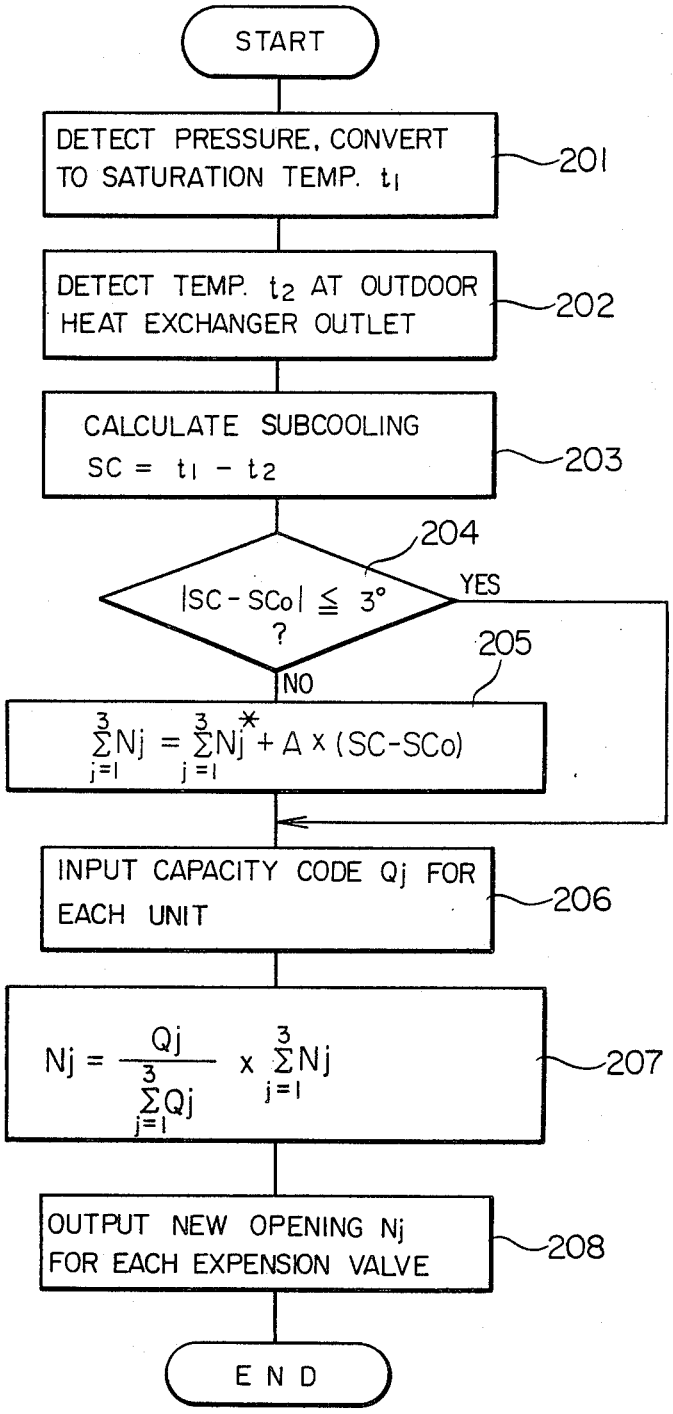
FIG. 11 is a flow chart of a program executed by the controller of FIG. 10.

The flow of refrigerant through the system during cooling and heating mode is identical to that of the previous embodiments. However, the control program executed by the controller 30 is somewhat different from in the previous embodiments and is illustrated for cooling operation by the flow chart of FIG. 11. In the same manner as in the embodiment of FIG. 3, the controller 30 determines the degree of subcooling at the outlet of the outdoor heat exchanger 3 and calculates a new value for the total degree of opening of the expansion valves 25*a*–25*c* if the degree of subcooling SC differs from a target value SCo by more than a prescribed amount such as 3° C. Steps 201 through 205, in which this process is performed, are identical to Steps 101 through 105 of FIG. 6. Then, in Step 206, the capacity codes Qj are input to the CPU 33 from the three capacity-setting switches 45*a*–45*c*, and in Step 207, the CPU 33 calculates the degree of opening Nj for each expansion valve based on the new total degree of opening of all three expansion valves 25*a*–25*c* and the capacity codes Qj. The degree of opening Nj is determined such that the greater the capacity of a given indoor heat exchanger, the greater is the degree of opening Nj of the corresponding expansion valve. In Step 208, the CPU 33 then sends output signals to the expansion valves 25*a*–25*c* and changes the degree of opening Nj of each expansion valve to the value calculated in Step 207.

Thus, in this embodiment, the controller 30 controls the expansion valves 25*a*–25*c* during cooling so as to maintain the degree of subcooling at the outlet of the outdoor heat exchanger 3 near a target value SCo and controls the flow or refrigerant to the indoor heat exchangers 5*a*–5*c* so that each one is supplied refrigerant in an amount corresponding to its capacity.

As in the previous embodiments, the expansion valves 25*a*–25*c* are controlled during heating operation based on the output signals from the liquid-side temperature sensors 26*a*–26*c* and the pressure sensor 28 such that the degree of subcooling on the outlet sides of the indoor heat exchangers 5*a*–5*c* are uniform and maintained near a target value, and such that the amount of refrigerant which is supplied to each corresponds to its capacity as indicated by the capacity-setting switches 45*a*–45*c*. Furthermore, based on the output signals from the liquid-side temperature sensors 26*a*–26*c*, the expansion valves 25*a*–25*c* are controlled such that the temperatures at the outlets of the indoor heat exchangers 5*a*–5*c* are all approximately equal.

The embodiment of FIG. 9 employs a pressure sensor 28 to determine the saturation temperature on the high-pressure side, but a saturation temperature detecting circuit 40 like that shown in FIG. 7 can be used instead.

Furthermore, if gas-side temperature sensors 24*a*–24*c* like those shown in FIG. 3 are installed on the gas-side branch pipes 20*a*–20*c* of FIG. 9, based on the output signals from the temperature sensors 24*a*–24*c*, the controller 30 can control the expansion valves 25*a*–25*c* so that the temperatures on the outlet sides of the indoor heat exchangers 5*a*–5*c* during cooling operation are approximately equal to one another.

In a multiroom air conditioner, the amount of refrigerant which must be circulating through the system in order for the air conditioner to function properly varies depending upon the operating mode (cooling or heating) and on the number of indoor units which are in operation. The difference between the amount which is circulating through the system at any time and the total amount in the system is stored in the accumulator 4. Should a shortage develop in the total amount of refrigerant in the system, the cooling and heating capacity will be inadequate, and in some cases the compressor may become damaged. Therefore, it is very important to be able to determine whether there is an appropriate amount of refrigerant in the system when installing the air conditioner or when repairing the refrigerant circuit.

Figure 12:
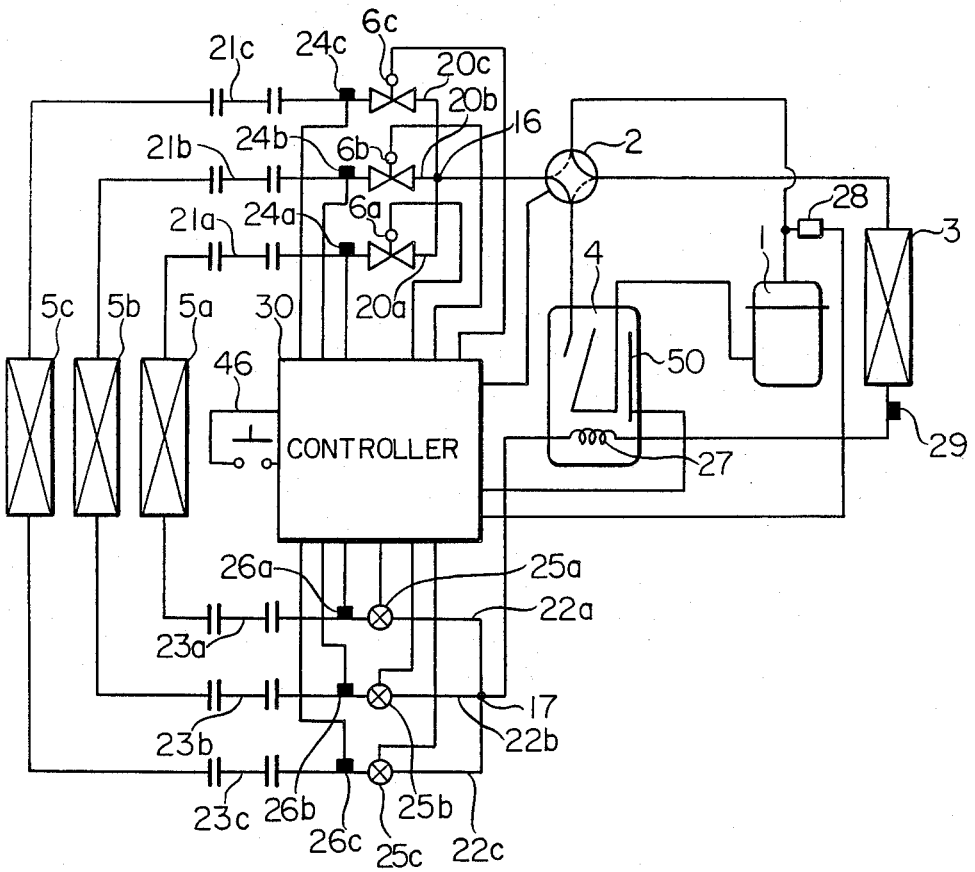
FIG. 12 is a schematic diagram of a fourth embodiment of the present invention which is equipped with a level detector for detecting the refrigerant level in the accumulator.

Accordingly, in a fourth embodiment of the present invention, the controller is capable of automatically indicating whether the amount of refrigerant in the system is adequate. This embodiment is illustrated in FIG. 12. The structure is nearly identical to that of the embodiment of FIG. 3 but further comprises a switch 46 which is closed when it is desired to check the amount of refrigerant in the system, and a level detector 50 which detects the level of liquid refrigerant in the accumulator 50 and provides a corresponding output-signal to the CPU 33 of the controller 30. The switch 46 is connected to the input circuit 31 of the controller 30.

Figure 13:
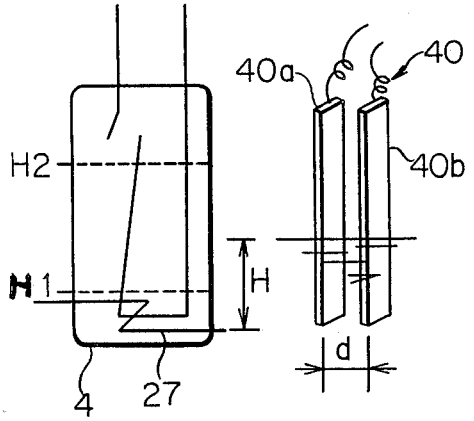
FIG. 13 is schematic illustration of the structure of the level detector of the embodiment of FIG. 12.
Figure 14:
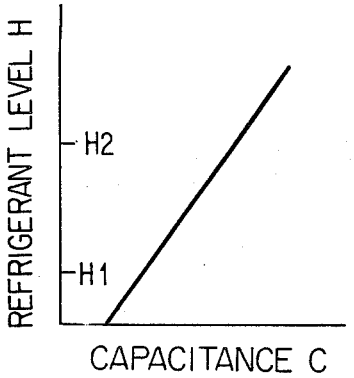
FIG. 14 is a graph showing the relationship between the refrigerant level in the accumulator and the capacitance of the electrode plates of the level detector.

The structure of the level detector 50 is illustrated in FIG. 13. In the present embodiment, the level detector 50 is a capacitance-type level gauge and comprises two parallel electrode plates 50*a* and 50*b* which are separated by a distance d. The electrode plates 50*a* and 50*b* are vertically disposed within the accumulator 4 and have a length such that they will always be partially immersed in the liquid refrigerant in the accumulator 4. For the sake of clarity, in FIG. 13 the electrode plates are shown on the outside of the accumulator 4.

The surface level of the refrigerant within the accumulator 4 is determined by measuring the capacitance of the electrode plates 50*a* and 50*b*, which varies in accordance with the level of the refrigerant in the manner expressed by the formula $$C=(E1\times A1+E2\times A2)\,/\,d$$

wherein E1 and E2 are the dielectric constants of the liquid refrigerant and the gaseous refrigerant, respectively, and A1 and A2 are the surface areas of those portions of the electrode plates which are below the surface and above the surface of the liquid refrigerant, respectively. When the refrigerant is R-22, the dielectric constants are approximately E1=6.6 and E2=1.03. As the surface areas A1 and A2 are directly proportional to the level H of the refrigerant in the accumulator 4, the total capacitance C increases as the level H increases. In FIG. 13, H1 is the minimum desirable surface level and H2 is the maximum desirable surface level in the accumulator 4. If the surface level H is less than H1, the heat exchanger 27 will not provide adequate cooling, while if the level exceeds H2, there is fear of the refrigerant overflowing, and therefore the surface level H is preferably somewhere between H1 and H2.

The flow of refrigerant through this embodiment during normal heating or cooling mode is identical to that of the embodiment of FIG. 3, and the same effects are provided. Furthermore, when a serviceman presses the switch 46, the controller 30 controls the operation of the air conditioner so as to automatically determine whether the amount of refrigerant in the system is adequate. A program which is executed by the CPU 33 at this time is illustrated in the flow chart of FIG. 15. First, in Step 301, it is determined whether switch 46 is on. If it is off, the program proceeds to Step 302 and the controller 30 performs control for normal operation in the manner previously described in accordance with the program illustrated in FIG. 6. However, if a serviceman has turned the switch 46 on in order to check the amount of refrigerant, then the program proceeds to Step 303 and sets Flag 1–Flag 3 to zero. In Step 304, it is determined whether Flag 1=1. As Flag 1 was just set to zero, the program proceeds to Step 306, in which the four-way valve 2 is switched to the position for cooling mode and cooling operation begins. In Step 307, each indoor unit is run one at a time in succession. At the start of operation of each indoor unit, the level H of refrigerant in the accumulator 4 is measured by the level detector 50 and input to the controller 30. When only one indoor unit is running, only a small amount of refrigerant circulates through the system and the remainder accumulates in the accumulator 4, so the largest amount of refrigerant is in the accumulator 4 at this time. Therefore, in Step 309, it is determined for each indoor unit whether H is greater than the maximum desirable level H2. If H>H2, then in Step 310, an unillustrated first LED, LED 1, is turned on as a signal to the serviceman, Flag 3 is set to 1, and the program proceeds to Step 311. Otherwise, the program proceeds directly from Step 309 to Step 311. In Step 311, all three indoor units are operated simultaneously. At this time, the amount of refrigerant which circulates through the system is a maximum and the amount of refrigerant in the accumulator 4 accordingly decreases. So, in Step 312, the level H is measured by the level detector 50, and in Step 313, it is determined whether H is below the minimum level H1. If it is not, the program proceeds directly to Step 315, but if H<H1, then in Step 314, a second LED, LED 2, is turned on, Flag 3 is set to 1, and the program proceeds to Step 315, in which Flag 1 is set to 1 to indicate that checking of the refrigerant level during cooling mode has been completed. In Step 316, it is checked whether Flag 2=1. As Flag 2 still has its initial value of zero, the program returns to Step 304. Flag 1 was set to 1 in Step 315, so the program proceeds from Step 304 to Step 305, in which Flag 2 is set to 1 and the four-way valve 2 is set to the position for heating operation. Steps 307 through 316 are then repeated for heating mode and the refrigerant level H is checked for individual operation of each indoor unit and for simultaneous operation of all three indoor units. As Flag 2 was set equal to 1 in Step 305, upon reaching Step 316, the program proceeds to Step 317 and checks whether Flag 3=0. If so, a third LED, LED 3, is turned on and the program ends.

Thus, when the refrigerant level H exceeds the maximum level H2 at any time during heating or cooling operation, LED 1 is turned on to indicate an excess of refrigerant; if the refrigerant level H at any time falls below the minimum level H1, LED 2 is turned on to indicate a shortage of refrigerant; furthermore, if the refrigerant level H is always between H1 and H2, then LED 3 is turned on, and the serviceman can immediately determine whether the refrigerant level in the accumulator is adequate.

Figure 15:
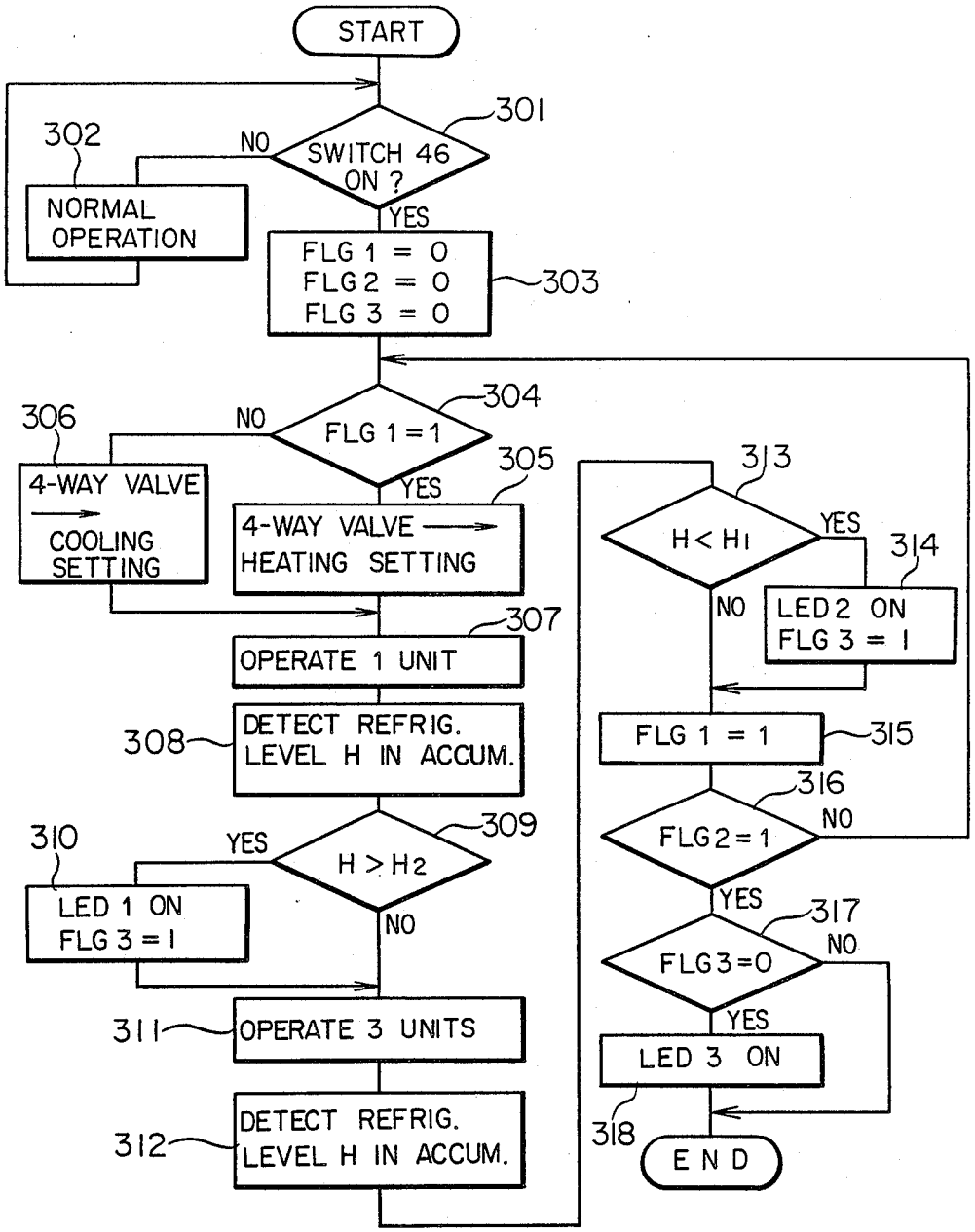
FIG. 15 is a flow chart illustrating a program executed by the controller of FIG. 12 for determining whether the amount of refrigerant in the system is adequate.

During the operation of the air conditioner during the process illustrated in FIG. 15, the expansion valves 25*a*–25*c* are controlled in the manner illustrated in the flow chart of FIG. 6.

If the rotational speed of the compressor 1 is controlled by an inverter or other means, during the procedure illustrated in FIG. 15, the rotational speed is automatically varied by the controller 30 over its entire operating range.

Figure 16:
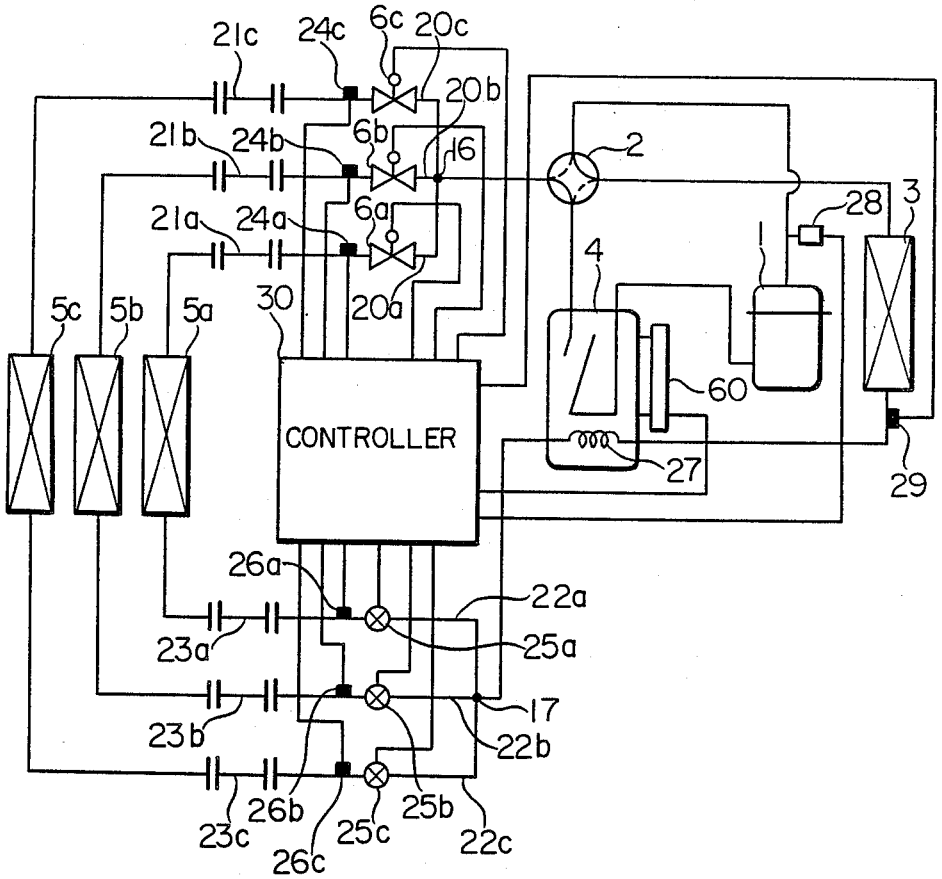
FIG. 16 is a schematic diagram of a fifth embodiment of the present invention which is equipped with another type of level detector.
Figure 17:
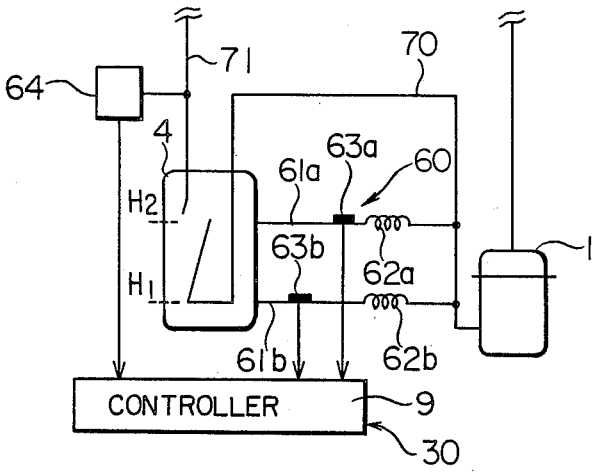
FIG. 17 is a schematic diagram of the level detector of FIG. 16.

FIG. 16 illustrates a fifth embodiment of the present invention which employs a different type of level detector 60 for determining the level of refrigerant in the accumulator 4 but which is otherwise identical in structure to the embodiment of FIG. 12. The structure of this level detector 60 is illustrated schematically in FIG. 17. An upper by-pass pipe 61*a* and a lower by-pass pipe 61*b* are connected between the inside of the accumulator 4 and the suction side of the compressor 1 via an upper capillary tube 62*a* and a lower capillary tube 62*b*, respectively. The upper by-pass pipe 61*a* opens onto the inside of the accumulator 4 at a height corresponding to the the maximum desirable level H2, while the lower by-pass pipe 61*b* opens onto the inside of the accumulator 4 at a height corresponding to the minimum desirable level H1. An upper temperature sensor 63*a* and a lower temperature sensor 63*b* are installed on the by-pass pipes 61*a* and 61*b*, respectively, and measure the temperatures therein. The output signals from the temperature sensors 63*a* and 63*b* are input to the controller 30. A pressure sensor 64 is installed so as to measure the pressure within the intake pipe 71 of the accumulator 4. The capillary tubes 62*a* and 62*b* open onto the discharge pipe 70 of the accumulator 4 near the suction inlet of the compressor 1 and serve to limit the flow of refrigerant through the by-pass pipes 61*a* and 61*b*.

Figure 18:
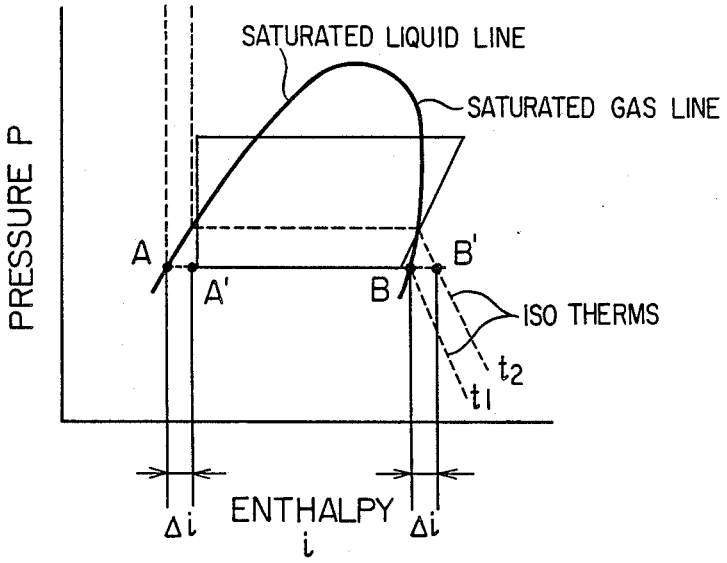
FIG. 18 is a Mollier diagram illustrating the state of the refrigerant in the level detector of FIG. 17.

The principles of operation of this level detector 60 will be explained while referring to FIG. 18, which is a Mollier diagram illustrating the state of the refrigerant in the by-pass pipes 61*a* and 61*b*. Refrigerant enters the accumulator 4 via the intake pipe 71 as a two-phase mixture having a saturation temperature t1, which can be determined from the pressure which is measured by the pressure sensor 64. The liquid portion of the refrigerant has an enthalpy corresponding to point A in FIG. 18, while the vapor portion has an enthalpy corresponding to point B. A small portion of the refrigerant which is contained in the accumulator 4 continually flows through the by-pass pipes 61*a* and 61*b* into the compressor 1. As the refrigerant temperature is considerably below that of the atmosphere, as it flows through the by-pass pipes, it undergoes heat exchange with the atmosphere through the walls of the by-pass pipes and undergoes an increase in enthalpy of $\Delta i$. If the refrigerant inside a by-pass pipe is in a liquid state, the change in enthalpy from point A to point A′ in FIG. 18 produces almost no increase in temperature, and the temperature detected by the temperature sensor mounted on that by-pass pipe is substantially equal to the saturation temperature t1. However, if vapor is flowing through the by-pass pipe, the same increase in enthalpy produces a change in the state of the vapor from point B to point B' of FIG. 18. The vapor within the by-pass pipe becomes superheated and the temperature thereof increases from t1 to t2, which is generally 5°-15° C. higher than the saturation temperature t1.

Thus, if the refrigerant level in the accumulator 4 is greater than the maximum level H2, liquid refrigerant will flow through both by-pass pipes 61*a* and 61*b*, and the temperatures measured by the temperature sensors 63*a* and 63*b* will both be roughly the same, i.e., approximately t1. If the refrigerant level is between H2 and H1, vapor will flow through the upper by-pass pipe 61*a* while liquid refrigerant will flow through the lower by-pass pipe 61*b*, so the temperature measured by temperature sensor 63*a* will be approximately t2 while that measured by temperature sensor 63*b* will be significantly lower at approximately t1. Furthermore, if the refrigerant level is below the minimum level H1, then gaseous refrigerant will flow through both of the by-pass pipes, and the temperatures measured by both temperature sensors 63*a* and 63*b* will be approximately t2. Therefore, based on the outputs of the temperature sensors 63*a* and 63*b*, the controller 30 can easily determine the refrigerant level H with respect to the minimum and maximum levels H1 and H2.

Except for the operation of the level detector 60, the operation of this embodiment is identical to that of the embodiment of FIG. 12. In both of these embodiments, a pressure sensor 28 is used to determine the saturation temperature on the high-pressure side, but the temperature detecting circuit 40 of FIG. 7 can be used instead. Furthermore, the capacity-setting switches 45*a*-45*c* of the embodiment of FIG. 9 can also be used with these embodiments.

In this embodiment, the saturation temperature in the accumulator 4 is calculated based on the pressure in the intake pipe 71 of the accumulator 4 which is measured by the pressure sensor 64, but a temperature sensor can instead be used to directly measure the saturation temperature.

Figure 19:
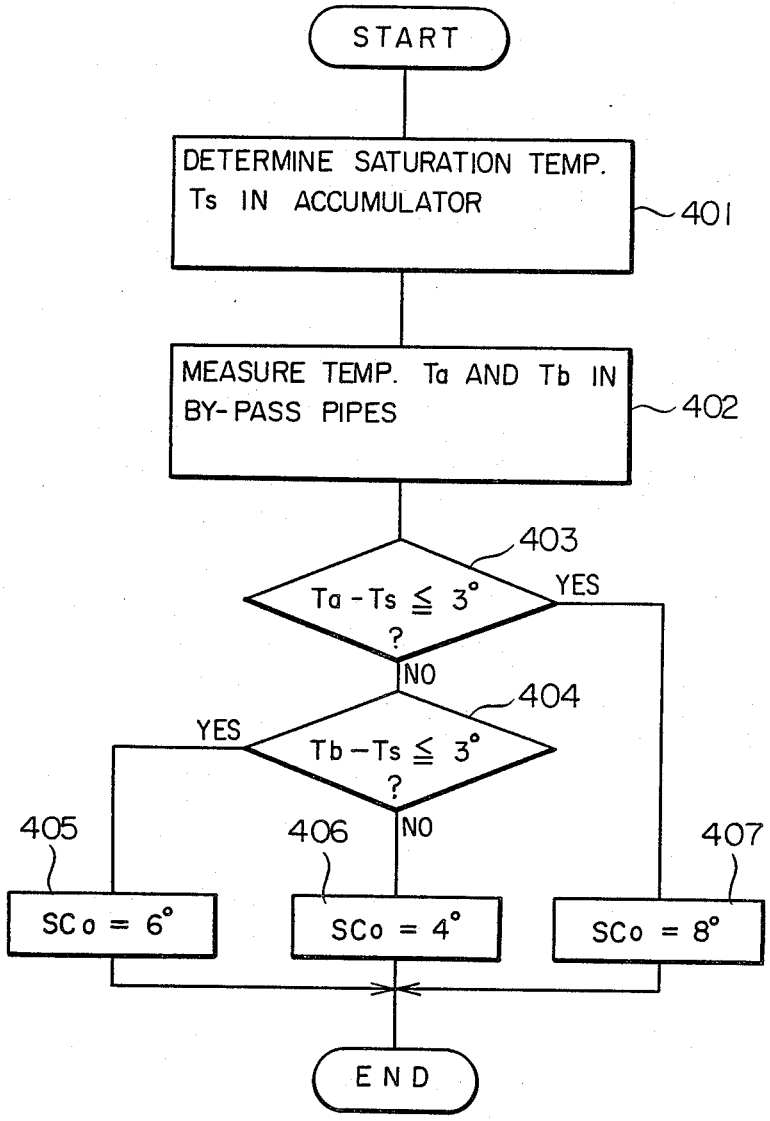
FIG. 19 is a flow chart of a program executed by the controller of the embodiment of FIG. 16 for adjusting the target degree of subcooling in accordance with the level of refrigerant in the accumulator.

In addition to automatically indicating to a serviceman whether the amount of refrigerant in the system is adequate, the controller 30 can also be programmed so as to automatically adjust the refrigerant level in the accumulator 4 based on the output of the level detector 50 or 60 so as to maintain a suitable level. The operation of such a program for use with the level detector 60 of FIG. 16 is illustrated in the flow chart of FIG. 19.

In Step 401 of the flow chart, the pressure within the intake pipe 71 of the accumulator 4 is measured by the pressure sensor 64, and based on the measured pressure, the controller 30 calculates the saturation temperature Ts within the accumulator 4. In Step 402, the temperature Ta in the upper by-pass pipe 61*a* and the temperature Tb in the lower by-pass pipe 61*b* are measured by the temperature sensors 63*a* and 63*b*, respectively, and are input to the controller 30. In Step 403, it is determined whether the difference between Ta and Ts exceeds a certain amount such as 3° C., and in Step 404, it is determined whether the difference between Tb and Ts exceeds 3° C. When either Ta or Tb is more than 3° C. greater than Ts, gaseous refrigerant is flowing through the corresponding by-pass pipe. Thus, in Step 403, if $Ta-Ts \leqq 3°$ C., it is determined that liquid is flowing through the upper by-pass pipe 61*a*, the refrigerant level is therefore higher than the maximum level H2, and the program goes to Step 407. In Step 404, if $Tb-Ts > 3°$ C., it is determined that gaseous refrigerant is flowing through the lower by-pass pipe 61*a*, the refrigerant level H is therefore below the minimum level H2, and the program goes to Step 405. Furthermore, in Step 404, if $Tb-Ts \leqq 3°$ C., it is determined that the refrigerant level is between the minimum level H1 and the maximum level H2, and the program goes to Step 406. In Steps 405-407, the target degree of subcooling SCo is set in accordance with the refrigerant level in the accumulator 4. When the surface level is between the minimum and maximum levels, in Step 405, SCo is set to a standard target value, such as 6° C. When the refrigerant level falls below the minimum level H1, then in Step 406, the target value SCo is set to a value which is lower than the standard target value, such as 4° C. When the refrigerant level exceeds the maximum level H2, then in Step 407, the target value SCo is set to a value which is higher than the standard target value, such as 8° C.

When the target value SCo is changed in Steps 405-407, the controller 30 then controls the expansion valves 25*a*-25*c* so as to bring the degree of subcooling SC at the outlet of the outdoor heat exchanger 3 towards the new target value SCo in the manner shown in the flow chart of FIG. 6. Thus, when there is too much refrigerant in the accumulator 4 and the controller 30 increases the target degree of subcooling in Step 407, the controller 30 then decreases the degree of opening of the expansion valves 25*a*-25*c* as shown in FIG. 6, a larger amount of liquid refrigerant accumulates in the condenser, the refrigerant level in the accumulator 4 decreases, and the refrigerant is prevented from overflowing. On the other hand, when there is too little refrigerant in the accumulator 4, the target degree of subcooling SCo is decreased in Step 406, the controller 30 increases the degree of opening of the expansion valves 25*a*-25*c* as shown in FIG. 6, and some of the liquid refrigerant within the condenser returns to the accumulator 4 to bring the refrigerant level above the minimum level H1.

Thus, even when there are variations in the amount of refrigerant circulating through the system due to changes in operating conditions, the controller 30 can maintain the proper amount of refrigerant in the accumulator and insure stable operation.

The control of the refrigerant level in the accumulator 4 was explained for the embodiment of FIG. 16, but the same manner of control can be performed for the embodiment of FIG. 12 which employs a capacitance-type level gauge.

In each of the previous embodiments, if a temperature sensor is disposed on the piping near the centers of the outdoor heat exchanger 3 and the indoor heat exchangers 5*a*-5*c*, the saturation temperature on the high-pressure side can be measured during both cooling and heating operation.

What is claimed is:

1. A multiroom air conditioner comprising:

a compressor;

an accumulator whose discharge side is connected to the suction side of said compressor;

an outdoor heat exchanger;

a plurality of indoor heat exchangers;

a plurality of gas-side branch pipes which converge at a gas-side confluence point, each of said gas-side branch pipes communicating with one side of one of said indoor heat exchangers;

a plurality of liquid-side branch pipes which converge at a liquid-side confluence point, each of said liquid-side branch pipes communicating with the other side of one of said indoor heat exchangers;

a four-way valve which is connected to the intake side of said accumulator, the discharge side of said compressor, the intake side during cooling of said outdoor heat exchanger, and said gas-side confluence point of said gas-side branch pipes and which can be switched between a cooling setting in which the discharge side of said compressor communicates with said outdoor heat exchanger and the intake side of said accumulator communicates with said gas-side confluence point, and a heating setting in which the discharge side of said compressor communicates with said gas-side confluence point and the intake side of said accumulator communicates with said outdoor heat exchanger;

a heat exchanger which is immersed in refrigerant within said accumulator and which is connected between the outlet side during cooling of said outdoor heat exchanger and said liquid-side confluence point;

a plurality of reversible expansion valves, each of which is installed on one of said liquid-side branch pipes;

a plurality of liquid-side temperature sensors, each of which is installed on one of said liquid-side branch pipes between the corresponding expansion valve and the corresponding indoor heat exchanger;

a plurality of solenoid valves, each of which is installed on one of said gas-side branch pipes;

a temperature sensor which is installed on the output side during cooling of said outdoor heat exchanger;

means for determining the saturation temperature on the high-pressure side of said compressor; and control means for controlling the degree of opening of said expansion valves based on the temperatures detected by all of said temperature sensors so that the degree of subcooling at the outlet during cooling of said outdoor heat exchanger is maintained at approximately a target value and such that the degree of subcooling at the outlets during heating of said indoor heat exchangers is maintained at approximately a target value.

2. A multiroom air conditioner as claimed in claim 1, wherein said control means further comprises means for controlling the degree of opening of said expansion valves such that the temperatures during heating in said liquid-side branch pipes are approximately equal to one another.

3. A multiroom air conditioner as claimed in claim 1, further comprising a plurality of gas-side temperature sensors, each of which is installed on one of said gas-side branch pipes between the corresponding indoor heat exchanger and the corresponding solenoid valve, said control means further comprising means for controlling the degree of opening of said expansion valves such that the temperatures in said gas-side branch pipes are approximately equal to one another during cooling operation, and such that the temperatures in said liquid-side branch pipes are approximately equal to one another during heating operation.

4. A multiroom air conditioner as claimed in claim 1, further comprising capacity-setting means for inputting the capacity of each of said indoor heat exchangers to said control means, said control means further comprising means responsive to said capacity-setting means for controlling the degree of opening of said expansion valves so that the amount of refrigerant which is supplied to each of said indoor heat exchangers corresponds to the capacity thereof.

5. A multiroom air conditioner as claimed in claim 4, wherein said capacity-setting means comprises a plurality of switches, each of which can be set to a setting corresponding to the capacity of one of said indoor heat exchangers.

6. A multiroom air conditioner as claimed in claim 1, further comprising level detecting means for detecting the level of liquid refrigerant in said accumulator.

7. A multiroom air conditioner as claimed in claim 6, wherein said level detecting means comprises a capacitance-type level gauge.

8. A multiroom air conditioner as claimed in claim 6, wherein said level detecting means comprises:

an upper by-pass pipe which communicates between the inside of said accumulator and the suction side of said compressor and which opens onto the inside of said accumulator at a height corresponding to the maximum desirable level of refrigerant in said accumulator;

a lower by-pass pipe which communicates between the inside of said accumulator and the suction side of said compressor and which opens onto the inside of said accumulator at a height corresponding to the minimum desirable level of refrigerant in said accumulator;

an upper temperature sensor and a lower temperature sensor which are disposed on said upper and lower by-pass pipes, respectively; and means for determining the saturation temperature in said accumulator.

9. A multiroom air conditioner as claimed in claim 6, wherein said control means further comprises means for automatically determining whether the amount of refrigerant in said air conditioner is adequate based on the refrigerant level which is detected by said level detecting means.

10. A multiroom air conditioner as claimed in claim 6, wherein said control means further comprises means for changing said target value for the degree of subcooling based on the level in said accumulator which is detected by said level detecting means, said target value being set to greater than a standard target value when the refrigerant level in said accumulator is greater than a maximum desirable level, to less than said standard target value when the refrigerant level is less than a minimum desirable level, and to said standard target value when said refrigerant level is between said minimum and said maximum desirable levels.

* * * * *